US008845216B2

(12) United States Patent
Igarashi

(10) Patent No.: US 8,845,216 B2
(45) Date of Patent: Sep. 30, 2014

(54) PRINTER AND PRINTING METHOD

(75) Inventor: Hitoshi Igarashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 124 days.

(21) Appl. No.: 13/253,458

(22) Filed: Oct. 5, 2011

(65) Prior Publication Data

US 2012/0087707 A1 Apr. 12, 2012

(30) Foreign Application Priority Data

Oct. 6, 2010 (JP) ..... 2010-226834

(51) Int. Cl.
*B41J 15/00* (2006.01)
*B41J 15/16* (2006.01)
*B41J 11/42* (2006.01)

(52) U.S. Cl.
CPC ..... *B41J 15/16* (2013.01); *B41J 11/425* (2013.01)
USPC ..... 400/618; 400/611

(58) Field of Classification Search
USPC ..... 400/618
See application file for complete search history.

(56) References Cited

U.S. PATENT DOCUMENTS

| | | | | |
|---|---|---|---|---|
| 3,679,200 | A * | 7/1972 | Bailey et al. | 270/4 |
| 4,277,034 | A * | 7/1981 | Buzzell | 242/417.3 |
| 4,611,799 | A * | 9/1986 | Nuttin | 270/52.01 |
| 4,719,855 | A * | 1/1988 | Cannon et al. | 101/485 |
| 4,966,352 | A * | 10/1990 | Nuttin | 270/1.01 |
| 5,423,620 | A * | 6/1995 | Tokairin | 400/582 |
| 5,813,343 | A * | 9/1998 | Harb | 101/407.1 |
| 6,052,144 | A * | 4/2000 | Reyner | 347/262 |
| 6,684,776 | B2 * | 2/2004 | Cote et al. | 101/228 |
| 6,799,507 | B2 * | 10/2004 | Ohba et al. | 101/228 |
| 6,993,964 | B2 * | 2/2006 | Franz et al. | 73/159 |
| 7,187,142 | B2 * | 3/2007 | Rehm | 318/400.04 |
| 7,395,025 | B2 * | 7/2008 | Matsuzuki et al. | 399/384 |
| 8,206,046 | B2 * | 6/2012 | Koyabu | 400/149 |

FOREIGN PATENT DOCUMENTS

| | | |
|---|---|---|
| JP | 2003-276918 A | 10/2003 |
| JP | 2009-091146 A | 4/2009 |
| JP | 2009-198616 A | 9/2009 |
| JP | 2009-208921 A | 9/2009 |

* cited by examiner

*Primary Examiner* — Anthony Nguyen
(74) *Attorney, Agent, or Firm* — Global IP Counselors, LLP

(57) ABSTRACT

A printer includes a roll paper body driving mechanism that transports a medium by rotating a roll paper body on which the medium is wound, a first transport mechanism provided downstream of the roll paper body to transport the medium, a print head provided downstream of the first transport mechanism to carry out printing on the medium, a second transport mechanism provided between the roll paper body and the first transport mechanism to transport the medium, and a controller carries out control so that, in a range in which a velocity at which the first transport mechanism transports the media changes, the absolute value of a difference in an amount by which the medium is transported between transport mechanisms is larger between the roll paper body driving mechanism and the second transport mechanism than between the second transport mechanism and the first transport mechanism.

10 Claims, 12 Drawing Sheets

PRINTER AND PRINTING METHOD

BACKGROUND

1. Technical Field

The present invention relates to a printer and a printing method.

2. Related Art

A printer carries out printing by expelling a jet of ink from a nozzle so that ink droplets (dots) adhere to a medium (roll paper). Another type of printer has a roll paper printing mechanism that appropriately feeds a medium from paper wound in a roll shape (roll paper) by an amount required for printing and carries out printing. During printing, these types of printers adjust an amount by which the medium is transported by controlling an amount by which roll paper is rotated and an amount by which a transport roller that transports the medium (paper) fed from roll paper is rotated.

A printer having a roll paper printing mechanism controls the amounts of roll paper rotation and roller rotation so that a certain tension is applied to the medium to prevent the medium from slackening while the medium is being transported. Since the medium is consumed as printing proceeds and the roll diameter of the roll paper is reduced, however, the amount of roll paper rotation is not correctly controlled. Accordingly, it has been difficult to constantly apply a certain tension to the medium being printed.

To solve the above problem, a method has been proposed in which the amount of roll paper rotation is adjusted by controlling the torque setting of a motor that drives roll paper in correspondence with a change in the roll diameter, enabling a certain tension to be constantly applied to the medium (see JP-A-2009-208921, for example).

In the method in JP-A-2009-208921, an inertia generated due to the rotation of roll paper during printing is not considered. When roll paper with a large roll diameter is used in a large printer for business use or the like, for example, a large inertia is generated accordingly. If the large inertia is applied during the control of the roll paper driving motor or transport roller, response characteristics are worsened in acceleration and deceleration of the motor or the like and control precision is lowered. Since, in particular, the transport roller needs to repeatedly control the transport and stop of the medium being printed, if the operation of the transport roller is affected by the inertia, it becomes difficult to precisely transport the medium.

SUMMARY

An advantage of some aspects of the invention is to enable a printer having a roll paper printing mechanism to achieve medium transport in which the operation of a transport roller is not easily affected by an inertia caused by roll paper.

A printer according to an aspect of the invention includes (A) a roll paper body driving mechanism that transports a medium in a transport direction by rotating a roll paper body on which the medium is wound in a roll shape and a roll paper body driver that drives the roll paper body driving mechanism, (B) a first transport mechanism provided downstream of the roll paper body in the transport direction to transport the medium and a first driver that drives the first transport mechanism, (C) a second transport mechanism provided between the roll paper body and the first transport mechanism to transport the medium and a second driver that drives the second transport mechanism, and (D) a controller that controls the operations of the roll paper body driver, first driver, and second driver so that, in a range in which a velocity at which the first transport mechanism transports the media changes, the absolute value of a difference between an amount by which the medium is transported by the roll paper body driving mechanism and an amount by which the medium is transported by the second transport mechanism is larger than the absolute value of a difference between an amount by which the medium is transported by the second transport mechanism and an amount by which the medium is transported by the first transport mechanism.

Other features of the aspects of the invention will be clarified by this description and the attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
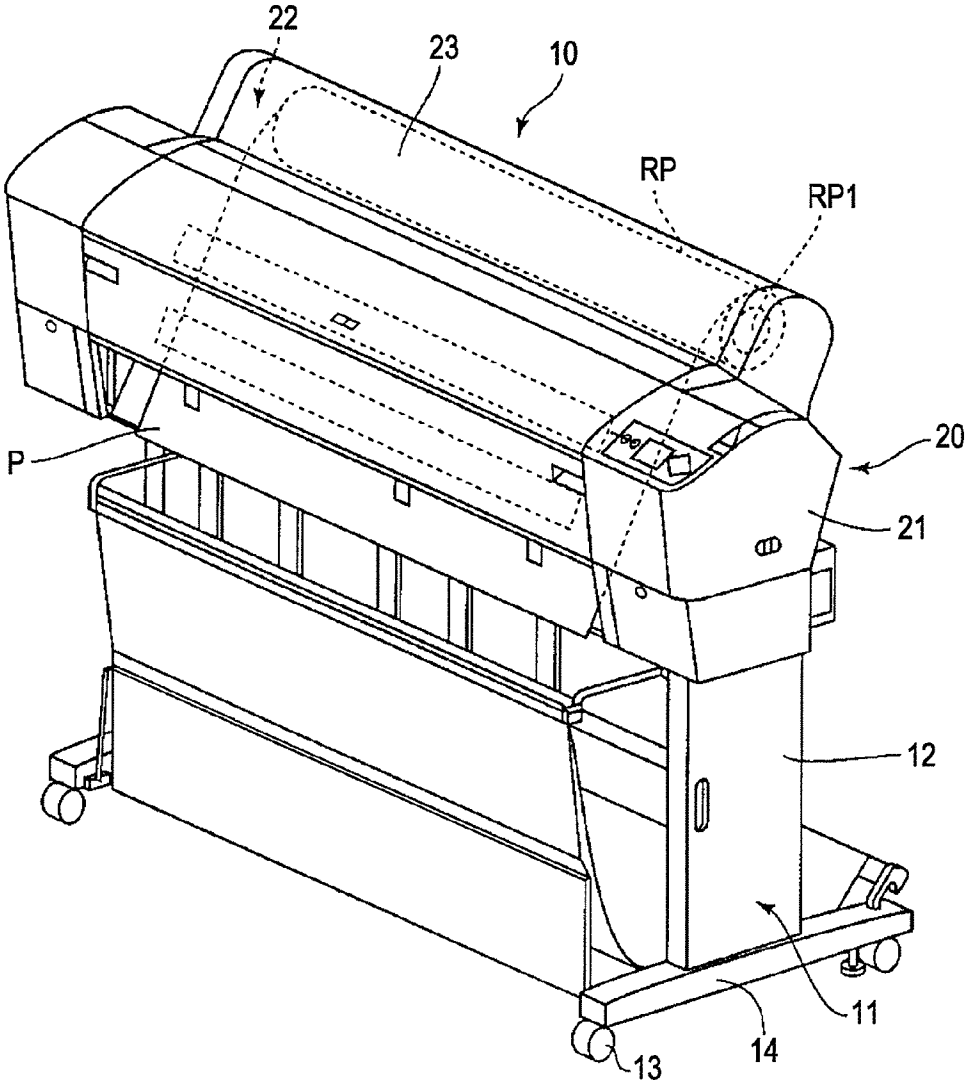
FIG. 1 is a perspective view showing an example of the external structure of a printer according to an embodiment of the invention.

At least the following will be clarified by this description and the attached drawing.

A printer includes (A) a roll paper body driving mechanism that transports a medium in a transport direction by rotating a roll paper body on which the medium is wound in a roll shape and a roll paper body driver that drives the roll paper body driving mechanism, (B) a first transport mechanism provided downstream of the roll paper body in the transport direction to transport the medium and a first driver that drives the first transport mechanism, (C) a second transport mechanism provided between the roll paper body and the first transport mechanism to transport the medium and a second driver that drives the second transport mechanism, and (D) a controller that controls the operations of the roll paper body driver, first driver, and second driver so that, in a range in which a velocity at which the first transport mechanism transports the media changes, the absolute value of a difference between an amount by which the medium is transported by the roll paper body driving mechanism and an amount by which the medium is transported by the second transport mechanism is larger than the absolute value of a difference between an amount by which the medium is transported by the second transport mechanism and an amount by which the medium is transported by the first transport mechanism.

This type of printer can achieve medium transport which is not easily affected by an inertia caused by the rotation of roll paper.

It is desirable that the controller of the printer control the operations of the roll paper body driver, first driver, and second driver so that, in a range from when the first transport mechanism starts the transport of the medium until it terminates the transport of the medium, the absolute value of a difference between an amount by which the medium is transported by the roll paper body driving mechanism and an amount by which the medium is transported by the second transport mechanism is larger than the absolute value of a difference between an amount by which the medium is transported by the second transport mechanism and an amount by which the medium is transported by the first transport mechanism.

This type of printer can achieve medium transport that is less affected by an inertia even while the transport roller is being accelerated or desecrated, during which the medium transport is likely to be affected by the inertia.

It is desirable that the controller of the printer control the operations of the roll paper body driver, first driver, and second driver so that, in a range from when printing is started until it is terminated, the absolute value of a difference between an amount by which the medium is transported by the roll paper body driving mechanism and an amount by which the medium is transported by the second transport mechanism is larger than the absolute value of a difference between an amount by which the medium is transported by the second transport mechanism and an amount by which the medium is transported by the first transport mechanism.

This type of printer can achieve medium transport that is less affected by an inertia in each printing operation.

It is desirable that the printer have a slack detector that detects the amount of slack of the medium between the roll paper body driving mechanism and the second transport mechanism, the controller drive the roll paper body driving mechanism if the amount of slack detected by the slack detector is less than or equal to a predetermined amount of slack, and the controller stop the roll paper body driving mechanism if the amount of slack detected by the slack detector is larger than the predetermined amount of slack.

This type of printer can control the driving of the roll paper body according to the amount of slack alone, and can achieve medium transport that is less affected by an inertia.

It is desirable that the controller detect the amount of slack of the medium between the roll paper body driving mechanism and the second transport mechanism according to an amount by which the medium is transported by the roll paper body driving mechanism and an amount by which the medium is transported by the second transport mechanism, the controller drive the roll paper body driving mechanism if the amount of detected slack is less than or equal to a predetermined amount of slack, and the controller stop the roll paper body driving mechanism if the amount of detected slack is larger than the predetermined amount of slack.

This type of printer can control the driving of the roll paper body according to the amount of slack alone without having to use a slack sensor and other extra devices, and can achieve medium transport that is less affected by an inertia.

A printing method is clarified that (A) transports a medium in a transport direction by driving a roll paper body driving mechanism that drives a roll paper body on which the medium is wound in a roll shape,(B) transports the medium by driving a first transport mechanism provided downstream of the roll paper body in the transport direction, (C) transports the medium by driving a second transport mechanism provided between the roll paper body and the first transport mechanism, and (D) makes, in a range in which a velocity at which the first transport mechanism transports the media changes, the absolute value of a difference between an amount by which the medium is transported by the roll paper body driving mechanism and an amount by which the medium is transported by the second transport mechanism larger than the absolute value of a difference between an amount by which the medium is transported by the second transport mechanism and an amount by which the medium is transported by the first transport mechanism.

A printer is clarified that includes (A) a roll paper body driving mechanism that transports a medium in a transport direction by rotating a roll paper body on which the medium is wound in a roll shape and a roll paper body driver that drives the roll paper body driving mechanism, (B) a first transport mechanism provided downstream of the roll paper body in the transport direction to transport the medium and a first driver that drives the first transport mechanism, (C) a second transport mechanism provided between the roll paper body and the first transport mechanism to transport the medium and a second driver that drives the second transport mechanism, and (D) a controller that controls the operations of the roll paper body driver, first driver, and second driver so that the second transport mechanism transports the medium by an amount of transport equivalent to an amount of transport carried out by the first transport mechanism with the medium slackened between the roll paper body driving mechanism and the second transport mechanism.

This type of printer can achieve medium transport that is not easily affected by an inertia caused by the rotation of roll paper.

A printing method is clarified that (A) transports a medium in a transport direction by driving a roll paper body driving mechanism that drives a roll paper body on which the medium is wound in a roll shape, (B) transports the medium by driving a first transport mechanism provided downstream of the roll paper body in the transport direction, (C) transports the medium by driving a second transport mechanism provided between the roll paper body and the first transport mechanism, and (D) causes the second transport mechanism to transport the medium by an amount of transport equivalent to an amount of transport carried out by the first transport mechanism with the medium slackened between the roll paper body driving mechanism and the second transport mechanism.

Basic Structure of the Printer

The printer 10 used in an embodiment of the invention and a method of controlling its driving will be described. The printer 10 is a printer that can carry out printing on a large-sized medium (printing form with a size of at least A2 in the JIS standard, for example). Although the printer 10 in the embodiment is an ink jet printer, the ink jet printer may adopt any jetting method if it can carry out printing by expelling a jet of ink.

In the description that follows, the lower side refers to a side on which the printer 10 is installed and the upper side refers to a side apart from the side on which the printer 10 is installed. A supply side (back) is a side from which a medium is supplied, and an ejection side (front) is a side to which the medium is ejected. Structure of the printer 10

Figure 2:
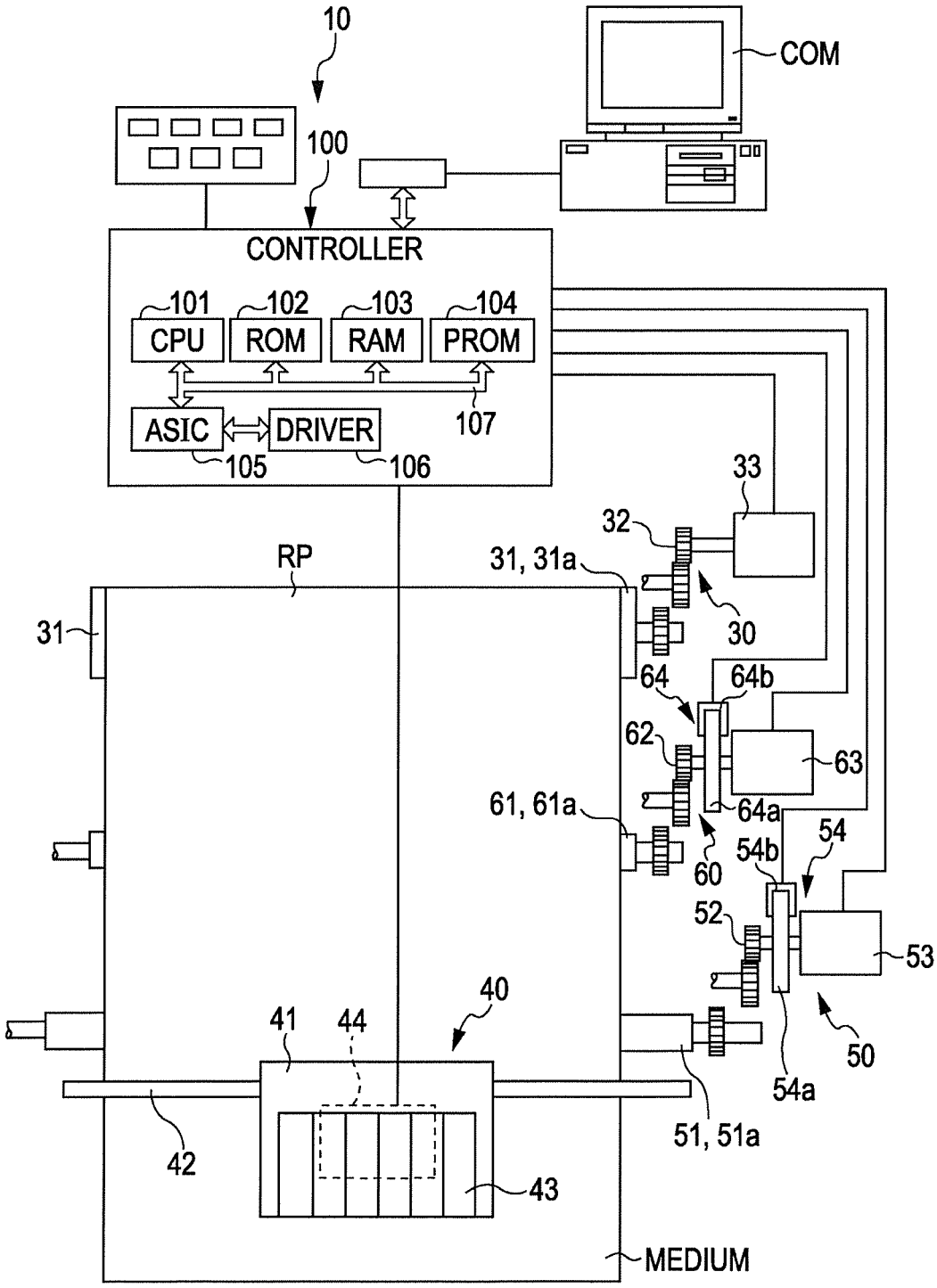
FIG. 2 shows a relationship, in the printer, between a control system and a driving system in which a DC motor is used.
Figure 3:
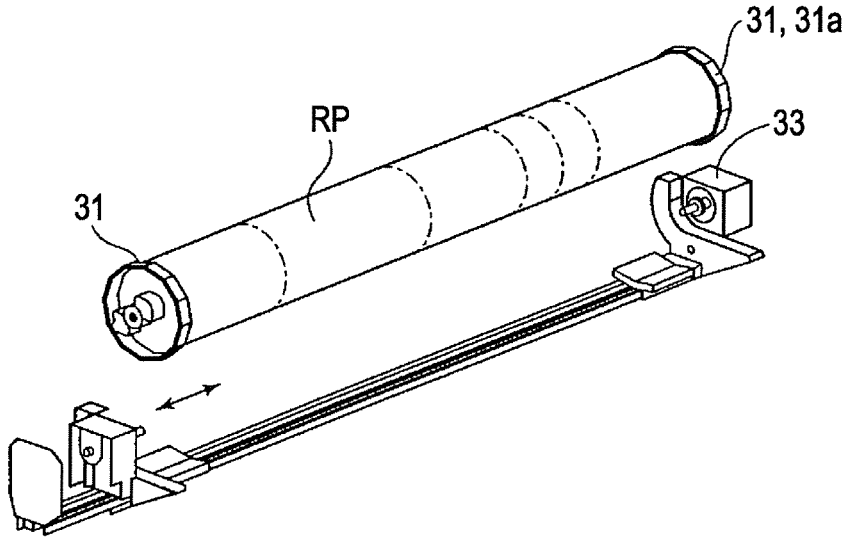
FIG. 3 is a perspective view showing the structure of rotational holders that hold a roll paper body RP.

FIG. 1 is a perspective view showing an example of the external structure of a printer 10 according to an embodiment of the invention. FIG. 2 shows a relationship, in the printer 10 in FIG. 1, between a control system and a driving system in which a DC motor is used. FIG. 3 is a perspective view showing an example of the external structure of rotational holders 31 and a roll motor 33.

The printer 10 in this example has a pair of legs 11 and a main body 20 supported by the legs 11. Each leg 11 has a column 12 and rotatable casters 13 attached to a caster support 14.

The main body 20 is supported by a chassis (not shown). Various units mounted in the main body 20 are covered by an external case 21. The driving system of the main body 20, in which a DC motor is used, includes a roll paper body driving mechanism 30, a carriage driving mechanism 40, a medium transport mechanism 50, and a transport adjusting mechanism 60, as shown in FIG. 2.

The roll paper body driving mechanism 30 is disposed in a roll mounting section 22 provided in the main body 20. The roll mounting section 22 is disposed at the upper side of the back of the main body 20 as shown in FIG. 1. When an open/close lid 23, which is one element of the external case 21 described above, is opened, roll paper body RP can be mounted in the roll mounting section 22, and the rotation of the roll paper body RP can be driven by the roll paper body driving mechanism 30.

The roll paper body driving mechanism 30, which rotates the roll paper body RP, includes the rotational holders 31, a gear train 32, and the roll motor 33 as shown in FIGS. 2 and 3. The rotational holders 31, which are paired, are inserted from both ends of a hollow RP1 formed in the roll paper body RP and support the roll paper body RP from both ends. The roll paper body RP is formed by winding a medium (such as paper P, for example) in a roll shape. When the roll paper body RP is rotated, the paper P is drawn out by an amount used for printing and fed to the medium transport mechanism 50 and transport adjusting mechanism 60.

The roll motor 33 gives a driving force (rotational force) to a rotational holder 31*a* at one end of the paired rotational holders 31 through the gear train 32. That is, the roll motor 33 is equivalent to a motor that gives a driving force with which the roll paper body RP is rotated.

The roll motor 33 can freely change its rotational direction. In the description that follows, the direction in which the roll motor 33 rotates to feed the medium in a supply direction (also referred to below as the transport direction) will be referred to as the normal direction, and the direction opposite to the normal direction will be referred to as the reverse direction.

A driver, in the roll paper body driving mechanism 30, that rotates the roll paper body RP is not limited to a motor such as the roll motor 33; it may be an actuator that is hydraulically operated, for example.

The carriage driving mechanism 40 includes a carriage 41, which is also a constituent element of an ink supply/jet mechanism, a carriage axis 42, and a carriage motor (not shown), a belt (not shown), and the like.

The carriage 41 has ink tanks 43 that store inks in various colors. An ink can be supplied to each ink tank 43 from an ink cartridge (not shown) secured to the front of the main body 20 through a tube (not shown). A print head 44, which can spray ink droplets, is provided at the bottom of the carriage 41 as shown in FIG. 2. The print head 44 has a nozzle string (not shown) in correspondence to different inks. A piezoelectric device is provided in each nozzle of the nozzle string. When the piezoelectric device operates, droplets can be sprayed from the nozzle disposed at an end of an ink passage.

The carriage 41, the ink tanks 43, the print head 44, tubes (not shown), and ink cartridges (not shown) constitute the ink supply/jet mechanism. The print head 44 is not limited to the piezoelectric method in which a piezoelectric device is used for driving; a heater method, in which an ink is heated by a heater and a force of generated foam is used, a magnetostriction method, in which magnetostriction devices are used, and a mist method, in which mists are controlled by an electric field, may be used, for example. The ink cartridges or ink tanks 43 may be filled with any types of inks (such as, for example, dye inks and pigment inks).

Figure 4:
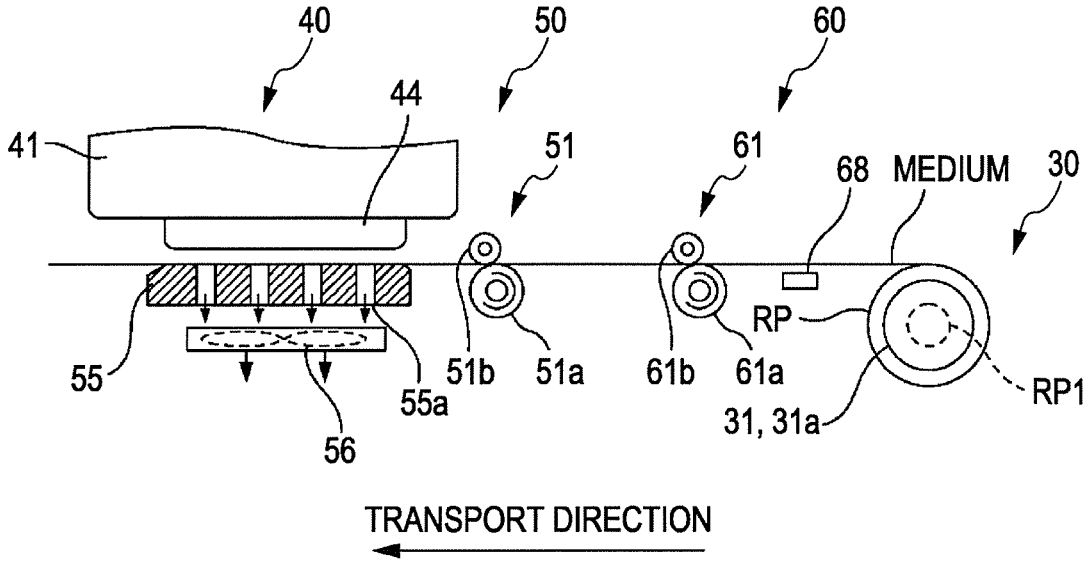
FIG. 4 shows a positional relationship among the roll paper body RP, paired transport rollers, paired transport adjusting rollers, and a print head.

FIG. 4 shows a positional relationship among the medium transported from the paper roll RP, paired transport rollers 51, paired transport adjusting rollers 61, and the print head 44.

The medium transport mechanism 50 has the paired transport rollers 51, a gear train 52, a PF motor 53, and a rotation detector 54, as shown in FIGS. 2 and 4. The paired transport rollers 51 have a transport roller 51*a* and a driven transport roller 51*b*. The medium (paper P, for example) drawn out from the roll paper body RP and transported can be held between the transport roller 51*a* and driven transport roller 51*b*. Although the medium transport mechanism 50 in the printer 10 in the embodiment uses rollers to transport the medium, this is not a limitation; a belt or a suction mechanism may be used to transport the medium, for example.

The PF motor 53 gives a driving force (rotational force) to the transport roller 51*a* through the gear train 52. That is, the PF motor 53 is equivalent to a motor that gives a driving force with which the transport roller 51*a* is rotated. As with the roll motor 33, the PF motor 53 can freely change its rotational direction. In the description that follows, the direction in which the PF motor 53 rotates to feed the medium in the transport direction will be referred to as the normal direction, and the direction opposite to the normal direction will be referred to as the reverse direction. A driver that drives the transport roller 51*a* is not limited to a motor such as the PF motor 53; it may be an actuator that is hydraulically operated, for example.

The rotation detector 54 in the embodiment uses a rotary encoder. Therefore, the rotation detector 54 has a discal scale 54*a* and a rotary sensor 54*b*. The discal scale 54*a* has transmitting portions through which light is transmitted and shielding portions that shield light at constant intervals in the circumferential direction. The main components of the rotary sensor 54*b* are a light emitting device (not shown), a light receiving device (not shown), and a signal processing circuit (not shown).

Figure 5A:
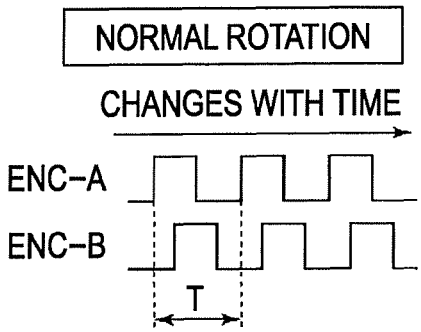
FIGS. 5A and 5B show ENC signals.
Figure 5B:
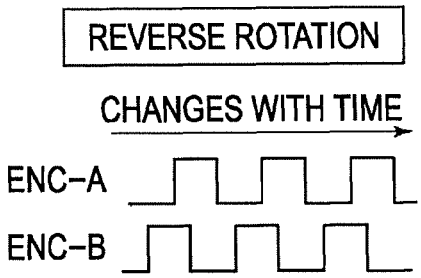

FIG. 5A is a timing diagram indicating waveforms of output signals while the PF motor 53 is rotated in the normal direction. FIG. 5B is a timing diagram indicating waveforms of output signals while the PF motor 53 is rotated in the reverse direction. In the embodiment, due to outputs from the rotary sensor 54*b*, pulse signals having a phase shift of 90 degrees (ENC signals in a phase A and ENC signals in a phase B), as shown in FIGS. 5A and 5B, are input to a controller 100. Accordingly, whether the PF motor 53 is rotated in the normal direction or reverse direction can be determined according to the advance or delay of the phase.

A platen 55 is provided downstream of the paired transport rollers 51 (on an ejection side) in the transport direction. The medium is guided on the platen 55 as shown in FIG. 4. The print head 44 is disposed above the platen 55 so as to face it. A suction hole 55*a* is formed in the platen 55 in such a way that the suction hole 55*a* can communicate with a suction fan 56. When the suction fan 56 is operated, air is inhaled from the same side as the print head 44 through the suction hole 55*a*. If the medium is placed on the platen 55, the medium can be held by suction. The printer 10 also has other various types of sensors including a medium width detecting sensor that detects the width of the medium.

The transport adjusting mechanism 60 has almost the same structure as the medium transport mechanism 50; the transport adjusting mechanism 60 includes the paired transport adjusting rollers 61, a gear train 62, an FC motor 63, and a rotation detector 64 as shown in FIG. 2. The paired transport adjusting rollers 61 have a transport adjusting roller 61*a* and a driven adjusting roller 61*b*. The medium drawn out from the roll paper body RP can be held between the transport adjusting roller 61*a* and a driven adjusting roller 61*b*. The FC motor 63 gives a driving force (rotational force) to the transport adjusting roller 61*a* through the gear train 62. That is, the FC motor 63 is equivalent to a motor that gives a driving force with which the transport adjusting roller 61*a* is rotated. As with the roll motor 33, the FC motor 63 can freely change its rotational direction. In the description that follows, the direction in which the FC motor 63 rotates to feed the medium in the transport direction will be referred to as the normal direction, and the direction opposite to the normal direction will be referred to as the reverse direction. A driver that drives the transport adjusting roller 61*a* is not limited to a motor such as the FC motor 63; it may be an actuator that is hydraulically operated, for example.

The transport adjusting mechanism 60, which is placed at a midpoint between the roll paper body RP and the medium transport mechanism 50, has a function to adjust an amount by which the medium is transported. The adjustment of the medium transport will be described later in detail.

A slack sensor 68 is provided between the paired transport adjusting rollers 61 and the roll paper body RP. The slack sensor 68, disposed below the medium, can detect a vertical position of the medium (a vertical relative position between the slack sensor 68 and the medium) between the paired transport adjusting rollers 61 and the roll paper body RP. By using the slack sensor 68, it is possible to acquire a slack amount, which indicates the amount of slack with respect to a vertical transport position measured when the medium is transported without a slack (while being tensioned).

About the Controller

Figure 6:
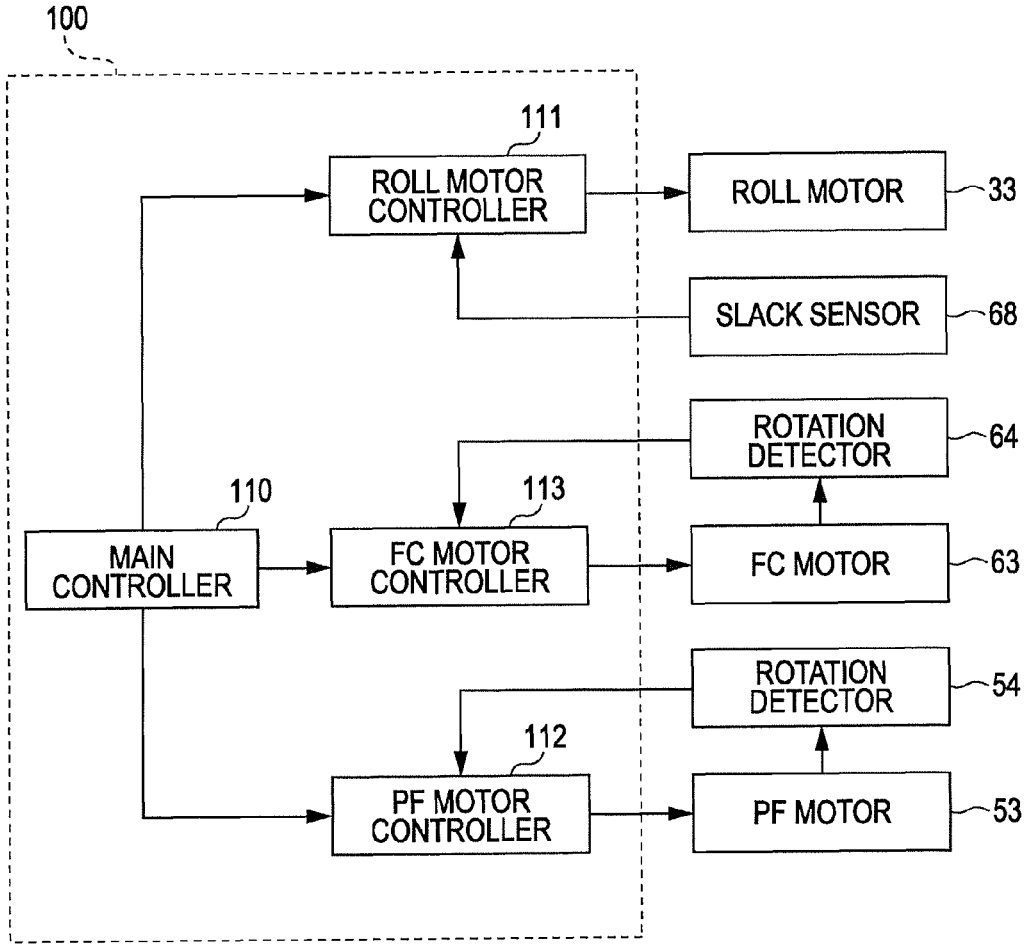
FIG. 6 is a block diagram showing an example of the functional structure of a controller.

FIG. 6 is a block diagram showing an example of the functional structure of the controller 100 in a first embodiment. In the first embodiment, the controller 100 receives signals output from the rotation detector 54 in the medium transport mechanism 50, the rotation detector 64 in the transport adjusting mechanism 60, the slack sensor 68, and a linear sensor (not shown). In addition, the controller 100 receives signals output from a paper width detecting sensor, a gap detecting sensor, a power switch that turns on and off power to the printer 10, and the like (none of these components are shown).

As shown in FIG. 2, the controller 100 includes a central processing unit (CPU) 101, a read-only memory (ROM) 102, a random-access memory (RAM) 103, a programmable read-only memory (PROM) 104, an application-specific integrated circuit (ASIC) 105, and a motor driver 106. These hardware components are mutually connected through a transmission path 107, such as, for example, a bus. The controller 100 is connected a computer COM. When the hardware components cooperate with software and/or data stored in the ROM 102 and PROM 104 or when a circuit or constituent component that carries out a specific process is added, a main controller 110, a roll motor controller 111, a PF motor controller 112, and an FC motor controller 113, as shown in FIG. 6, are implemented.

The main controller 110 controls the operations of the roll motor controller 111, PF motor controller 112, and FC motor controller 113 and performs a process to transport the medium in the transport direction. During this transport, the main controller 110 adjusts and controls a balance between an amount by which the medium is transported by the transport roller 51*a* and an amount by which the medium is supplied (transported) from the roll paper body RP so that the medium transport mechanism 50 is not affected by an inertia caused by the roll paper body RP.

The roll motor controller 111 controls the driving of the roll motor 33 according to the signal output from the slack sensor 68 so that an appropriate amount of medium is supplied (transported) to the medium transport mechanism 50 in the printer 10.

The PF motor controller 112 controls the driving of the PF motor 53 according to the signal output from the rotation detector 54. Then, the amount of rotation of the transport roller 51*a* is controlled and the medium is transported in the transport direction.

The FC motor controller 113 controls the driving of the FC motor 63 according to the signal output from the rotation detector 64. Then, the amount of rotation of the transport adjusting roller 61*a*, the amount of medium supplied from the roll paper body RP, and the amount of medium transported by the transport roller 51*a* are adjusted.

About A Printing Operation

When the printer 10 receives print data from the computer COM, the controller 100 controls the roll paper body driving mechanism 30, the carriage driving mechanism 40, and other units to perform a paper supply process, a dot forming process, a transport process, and other processes.

In the paper supply process, the medium on which to print is supplied from the roll paper body RP to the interior of the printer 10 and paper is positioned at a print start position (also referred to as a cuing position). The controller 100 rotates the roll paper body RP in the normal direction and feeds the medium to the transport adjusting roller 61*a* and transport roller 51*a*. The controller 100 then rotates the transport adjusting roller 61*a* and transport roller 51*a*, and positions the paper fed from the roll paper body RP at the print start position.

In the dot forming process, inks are discontinuously sprayed from the print head 44, which moves in a direction perpendicular to the transport direction of the medium (the direction will also be referred to as the movement direction), to form ink dots on the medium. The controller 100 moves the carriage 41 in the movement direction and sprays inks from the print head 44 according to print data while the carriage 41 is moving. When ink droplets adhere to the medium, dots are formed and a dot line of a plurality of dots is formed along the movement direction.

In the transport process, the medium is moved in the transport direction, relative to the head. The controller 100 rotates the transport roller 51*a* and transports paper in the transport direction. The transport process enables the print head 44 to form a dot at a position different from the position of the dot formed in the dot forming process described above. Control of the amount of medium transported during a transport will be described later.

The controller 100 alternately repeats the dot forming process and transport process until all data to be printed has been processed, gradually printing an image formed by dot lines on the paper. Finally, the controller 100 ejects the medium on which the image has been printed.

Comparative Example

First, medium transport without the transport adjusting mechanism 60 will be described as a comparative example.

Figure 7:
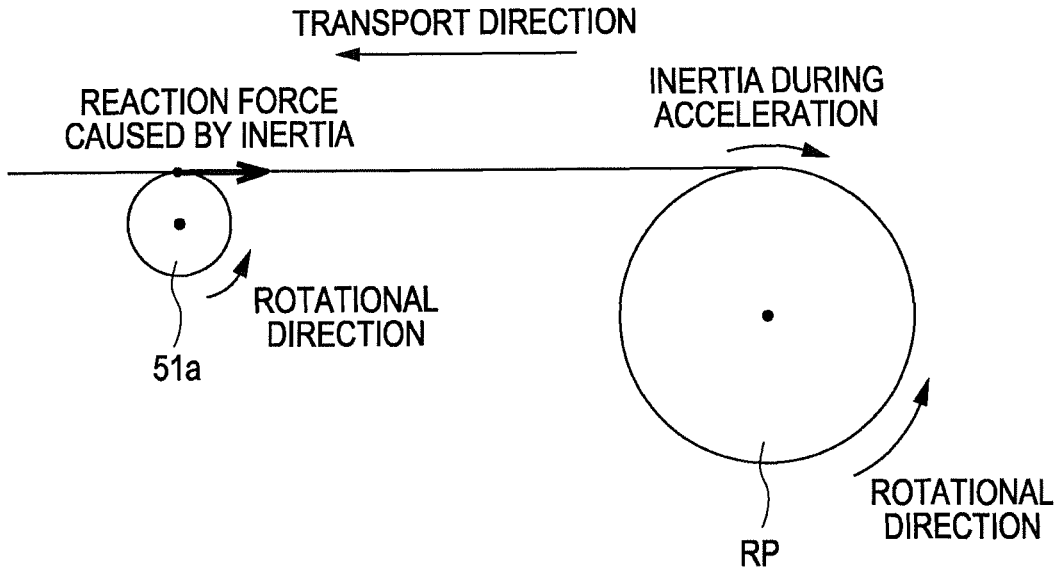
FIG. 7 schematically shows the rotations of rollers when a medium is transported in a comparative example.

FIG. 7 schematically shows the rotations of rollers when a medium is transported in the comparative example. With a printer in the comparative example, the medium fed from the roll paper body RP is sent directly to the transport roller 51*a* without intervention by the paired transport adjusting rollers 61. When the transport roller 51*a* is rotated in the normal direction, the medium is transported in the transport direction.

This type of printer is assumed to carry out printing by using a roll paper body RP with a large roll diameter. When a large mass of roll paper RP with a large roll diameter is rotated during the supply of the medium, a large inertia is generated accordingly. The inertia generated in the roll paper body RP could be considered to affect the rotation of the transport roller 51*a* through the medium.

Figure 8:
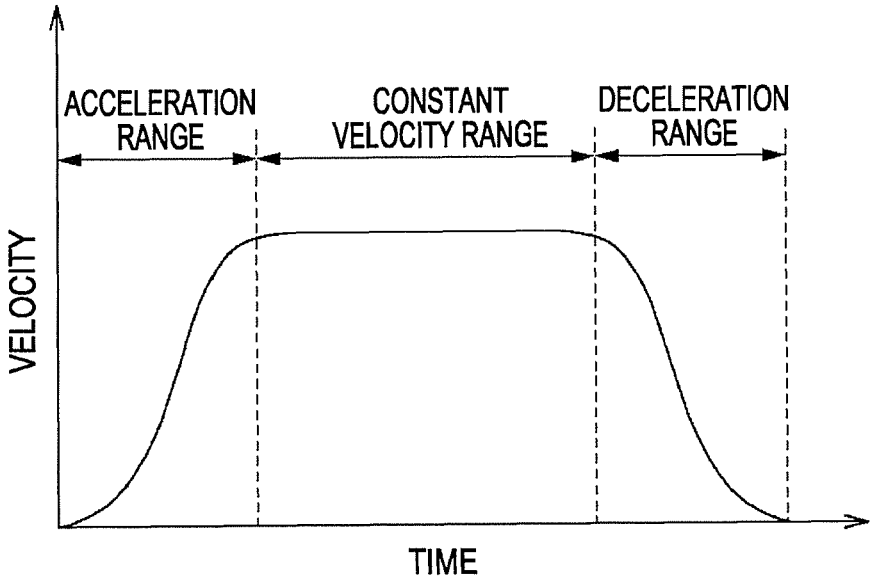
FIG. 8 illustrates the time-varying transport velocity of the medium transported by a transport roller.

For example, the printer in the comparative example prints an image by alternately repeating the transport process and dot forming process for the medium as described above. In this case, the transport roller 51*a* does not constantly transport the medium at a fixed velocity, but it transports the medium while being repeatedly rotated and stopped. That is, the medium is transported while the transport velocity changes at short intervals. FIG. 8 illustrates the time-varying transport velocity of the medium transported by the transport roller 51*a*. The transport roller 51*a* starts acceleration at the same time as the start of its rotation, and raises the transport velocity. When a predetermined target velocity is reached, the transport roller 51*a* terminates acceleration (the velocity is in the acceleration range in FIG. 8). Then, the transport roller 51*a* continues to be rotated while the constant velocity is maintained (the velocity in the constant velocity range in FIG. 8). When rotation is stopped, deceleration is started and the transport velocity is gradually lowered. When a predetermined velocity is reached, deceleration is terminated and the velocity is finally reduced to zero (the velocity is in the deceleration range in FIG. 8). The transport roller 51*a* repeats a series of operations described above to transport the medium.

If the rotational speed of the transport roller 51*a* is constant in the constant velocity range, even when the inertia is large, medium transport is less likely to be affected. This is because if the roll paper body RP continues to be rotated at the same velocity as the medium transport velocity of the transport roller 51*a*, that is, if the amount of medium transported by the transport roller 51*a* per unit time is equal to the amount of medium fed from the roll paper body RP per unit time, the inertia does not affect the rotation of the transport roller 51*a*.

When the rotational speed of the transport roller 51*a* is gradually increased in the acceleration range, the effect of the inertia becomes problematic. After the roll paper body RP has started to be rotated, its rotational speed is also gradually increased in correspondence to the rotation of the transport roller 51*a*. During this period, however, a large inertia is exerted due to the roll diameter and weight of the roll itself in a direction in which the rotation of the roll paper body RP is impeded. That is, a force with which the medium is tensioned in a direction opposite to the transport direction is generated. If this force is transmitted directly to the transport roller 51*a* through the medium, the operation to accelerate the rotation of the transport roller 51*a* is impeded, making control of medium transport difficult. Similarly, in the deceleration range, a large inertia is exerted in a direction in which the rotation of the roll paper body RP is continued. If this force is transmitted directly to the transport roller 51*a* through the medium, the operation to decelerate the rotation of the transport roller 51*a* is impeded, making control of medium transport difficult.

As described above, the rotational speeds of the transport roller 51*a* and roll paper body RP vary through the transport operation during printing. In particular, the variation of the rotational speed of the transport roller 51*a* becomes large when the rotation is started (in the acceleration range in FIG. 8) and when the rotation is stopped (in the deceleration range in FIG. 8). The inertia caused by the roll paper body RP is likely to affect the transport roller 51*a* accordingly. If the transport roller 51*a* is affected by the inertia, the rotation of the transport roller 51*a* cannot be accurately controlled. This may disturb the transport operation of the medium and may lower the quality of printed images.

First Embodiment

If the roll paper body RP is large (heavy), a large inertia is generated accordingly, as described above. In a range in which the rotation velocity of the transport roller 51*a* varies during printing, transport control becomes difficult due to the effect of the inertia. In this embodiment, therefore, the transport adjusting roller 61*a* is provided between the transport roller 51*a* and the roll paper body RP.

Figure 9:
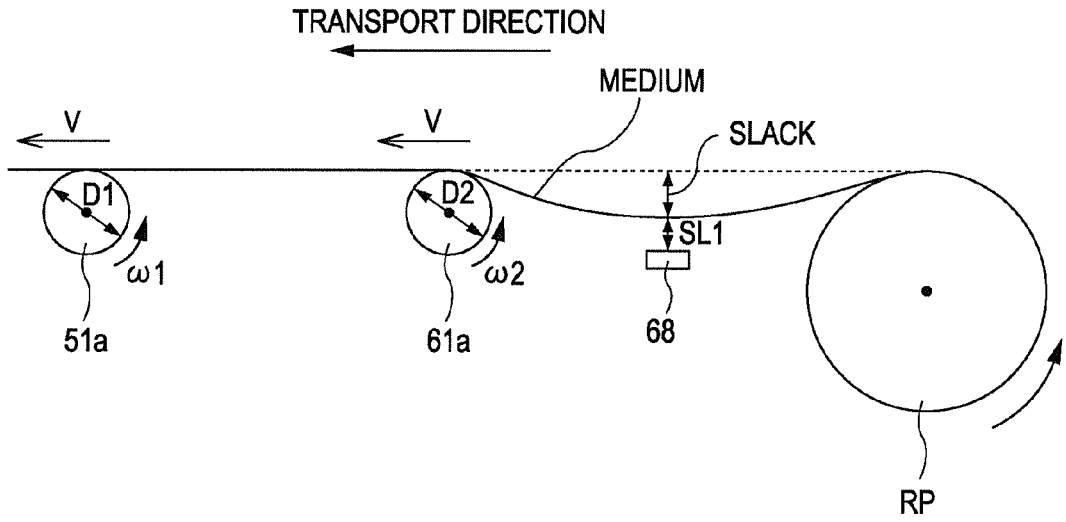
FIG. 9 schematically shows the rotations of rollers when the medium is transported in a first embodiment as well as the slack of the medium.

FIG. 9 schematically shows the rotations of rollers when the medium is transported in the first embodiment as well as the slack of the medium. Control is performed so that, during printing (during medium transport), the medium is constantly slackened while being transported between the transport adjusting roller 61*a* and the roll paper body RP and is not slackened while being transported between the transport roller 51*a* and the transport adjusting roller 61*a*. Since the medium is slackened between the transport adjusting roller 61*a* and the roll paper body RP so that the effect of the inertia generated by the roll paper body RP is eliminated by the slack of the medium, the effect of the inertia on the transport roller 51*a* is suppressed.

How the rotation of each roller is controlled will be described below.

Controlling the Rotation of the Transport Roller 51*a*

The transport roller 51*a* transports the medium at a certain velocity V in the transport direction.

If the diameter of the transport roller 51*a* (roller diameter) is denoted D1 and its angular velocity during rotation is denoted $\overline{\omega}1$, then the transport velocity V at which the medium is transported by the transport roller 51*a* is represented by equation (1).

$$V=\overline{\omega}1\times D1/2 \quad (1)$$

The PF motor controller 112 produces a pulse-width modulation (PWM) output and drives the PF motor 53 to rotate the transport roller 51*a* at the angular velocity $\overline{\omega}1$. The amount of rotation of the PF motor 53 per unit time is detected by the rotation detector 54. The current angular velocity of the transport roller 51*a* is calculated from the relationship between the detected amount of rotation and the gear ratio of the gear train 52. The PF motor controller 112 appropriately controls the rotational speed of the transport roller 51*a* so that the calculated angular velocity comes close to the target angular velocity $\overline{\omega}1$ and the medium is stably transported.

The transport roller 51*a* transports the medium while repeating acceleration, transport at a constant velocity, and deceleration, as shown in FIG. 8 as well. Therefore, the angular velocity $\overline{\omega}$1 also constantly changes through the printing operation.

Controlling the Rotation of the Transport Adjusting Roller 61*a*

The transport adjusting roller 61*a* follows the transport roller 51*a* and transports the medium in the transport direction at the same velocity V as the transport roller 51*a*. Accordingly, the medium is transported between the transport roller 51*a* and the transport adjusting roller 61*a* while maintaining a certain amount. If the diameter of the transport adjusting roller 61*a* (roller diameter) is denoted D2 and its angular velocity during rotation is denoted $\overline{\omega}$2, then the transport velocity V at which the medium is transported by the transport adjusting roller 61*a* is represented by equation (2).

$$V=\overline{\omega}2\times D2/2 \quad (2)$$

If V in equation (1) equals V in equation (2), since $V=\overline{\omega}1\times D1/2=\overline{\omega}2\times D2/2$, the following equation holds.

$$\overline{\omega}2\times\overline{\omega}1\times D1/D2 \quad (3)$$

That is, when the transport adjusting roller 61*a* is rotated at the angular velocity $\overline{\omega}$2 corresponding to the angular velocity $\overline{\omega}$1 of the transport roller 51*a*, the medium can be transported at the predetermined velocity V.

The FC motor controller 113 produces a PWM output and drives the FC motor 63 to rotate the transport adjusting roller 61*a* at the angular velocity $\overline{\omega}$2. The amount of rotation of the FC motor 63 per unit time is detected by the rotation detector 64. The current angular velocity of the transport adjusting roller 61*a* is calculated from the relationship between the detected amount of rotation and the gear ratio of the gear train 62. Thus, the FC motor controller 113 appropriately controls the rotational speed of the transport adjusting roller 61*a*, enabling the same amount of medium to be transported per unit time between the transport roller 51*a* and the transport adjusting roller 61*a*.

In this embodiment, while the medium is transported between the transport roller 51*a* and the transport adjusting roller 61*a*, a constant tension is maintained. To achieve this, when starting the transport of the medium, the main controller 110 rotates only the PF motor 53 in the normal direction before starting to rotate the FC motor 63. That is, the main controller 110 rotates only the transport roller 51*a* with the transport adjusting roller 61*a* stopping. The medium is thereby tensioned between the transport roller 51*a* and the transport adjusting roller 61*a* without being slackened. Whether the medium is slackened or not between the transport roller 51*a* and the transport adjusting roller 61*a* is determined by a slack sensor 58. After the slack of the medium, if any, is removed, the FC motor 63 is also rotated in the normal direction and the rotational speed of the transport adjusting roller 61*a* is controlled as described above.

At the start of medium transport, it is also possible to remove the slack of the medium between the transport roller 51*a* and the transport adjusting roller 61*a* by rotating the PF motor 53 in the normal direction and rotating the FC motor 63 in the reverse direction. After the slack has been removed from the medium, the FC motor 63 may be rotated in the normal direction and the rotational speed of the transport adjusting roller 61*a* may be controlled as described above.

Controlling the Rotation of the Roll Paper Body RP

The roll paper body RP is rotated by the roll motor 33 in the normal direction and supplies (transports) the medium toward the transport adjusting roller 61*a* and transport roller 51*a*. In this embodiment, to have the medium constantly slackened between the transport adjusting roller 61*a* and the roll paper body RP as shown in FIG. 9, the amount of rotation of the roll motor 33 is adjusted and controlled so that an appropriate amount of medium is supplied to the transport adjusting roller 61*a* and transport roller 51*a*.

To have the medium slackened between the transport adjusting roller 61*a* and the roll paper body RP, the medium must be more supplied from the roll paper body RP per unit time during printing than when the medium is transported by the transport adjusting roller 61*a* per unit time.

The amount of slack of the medium is monitored by the slack sensor 68. The slack sensor 68 used in this embodiment, which is disposed below the medium between the transport adjusting roller 61*a* and the roll paper body RP as shown in FIG. 9, detects a distance SL1 from the medium to be transported (vertical positional relation between the medium and the slack sensor 68). For example, suppose that the vertical distance between the medium and the slack sensor 68 is 10 cm when the medium has no slack. If the medium is slackened, since the position of the medium is lowered due to its own weight, the vertical distance between the medium and the slack sensor 68 is reduced. If the target value of SL1 to be detected has been set to 5 cm, when the detected value is less than or equal to 5 cm, the slack is large; when the detected value is larger than 5 cm, the slack is small (see FIG. 9). The slack sensor 68 monitors the amount of slack of the medium by detecting the vertical distance from the medium (positional relation) in this way.

The slack sensor 68 may be a device, having a scale, that enables the amount of slack to be visually monitored, instead of a device that measures a positional relation to the medium.

A case in which the target value of the distance SL1 from the medium in this embodiment is "h" will be described. When the distance SL1 detected by the slack sensor 68 is "h" or more, it implies that the amount of slack of the medium is smaller than an assumed reference value. Then, the roll motor controller 111 controls the roll motor 33 so that it rotates in the normal direction. That is, when the amount of slack of the medium falls below or to a predetermined reference value, the roll motor 33 is rotated to feed the medium from the roll paper body RP so that a sufficient amount of medium is supplied to the medium transport mechanism 50.

Conversely, when the distance SL1, detected by the slack sensor 68, from the medium is smaller than "h", it implies that the amount of slack of the medium is larger than the assumed reference value. Then, the roll motor controller 111 controls the roll motor 33 so as to stop its rotation. That is, when the amount of slack of the medium exceeds the predetermined reference value, the supply of the medium from the roll paper body RP is stopped for a while. Since, during printing, the transport roller 51*a* and transport adjusting roller 61*a* transport the medium in the transport direction at the predetermined speed of V, when the supply of the medium is stopped, the slack between the transport adjusting roller 61*a* and the roll paper body RP is gradually reduced. When the distance SL1 detected by the slack sensor 68 is increased again to at least a predetermined value ("h" in the above example), the roll motor 33 is rotated in the normal direction to supply the medium to the medium transport mechanism 50.

Since the roll paper body RP is very heavy, it may be difficult to brake the roll motor 33, for example, immediately after printing has been started. In control in which the roll motor 33 is repeatedly rotated and stopped at short intervals as described above, a large load may be applied to the roll motor 33.

In this case, the roll motor 33 may be first rotated and then stopped after a predetermined amount of medium (two meters of medium, for example) has been supplied so that an adequately large slack is formed between the transport adjusting roller 61*a* and the roll paper body RP in advance. When printing proceeds, the supplied medium is consumed, and the amount of slack falls below the predetermined target value, the roll motor 33 may be rotated again to supply an adequate amount of medium again and then the roll motor 33 may be stopped. This process may be repeated to have the medium slacked by the predetermined value or more between the transport adjusting roller 61*a* and the roll paper body RP. In this method, a rotation detector 34 described later may be attached to the roll motor 33. Variation in the transport velocity of the transport roller 51*a*

The medium supplied (transported) from the roll paper body RP is transported to the transport adjusting roller 61*a* and transport roller 51*a* in that order in the transport direction. The transport velocity of the medium is controlled by adjusting the rotational speed of the transport roller 51*a*. The roll paper body RP itself has a large mass and thereby generates a large inertia when it is rotated. In particular, when the rotational speed of the transport roller 51*a* varies, if the inertia generated by the roll paper body RP affects the rotational operation of the transport roller 51*a*, the rotation of the transport roller 51*a* cannot be accurately controlled, preventing the medium from being stably transported.

In this embodiment, therefore, the transport adjusting roller 61*a* is disposed between the transport roller 51*a* and the roll paper body RP, and an amount by which each motor is rotated is controlled so that the medium is adequately slackened between the transport adjusting roller 61*a* and the roll paper body RP in a certain range in which the velocity of the transport roller 51*a* varies. Therefore, the effect of the inertia generated by the roll paper body RP is eliminated by the slack of the medium between the transport adjusting roller 61*a* and the roll paper body RP.

Figure 10:
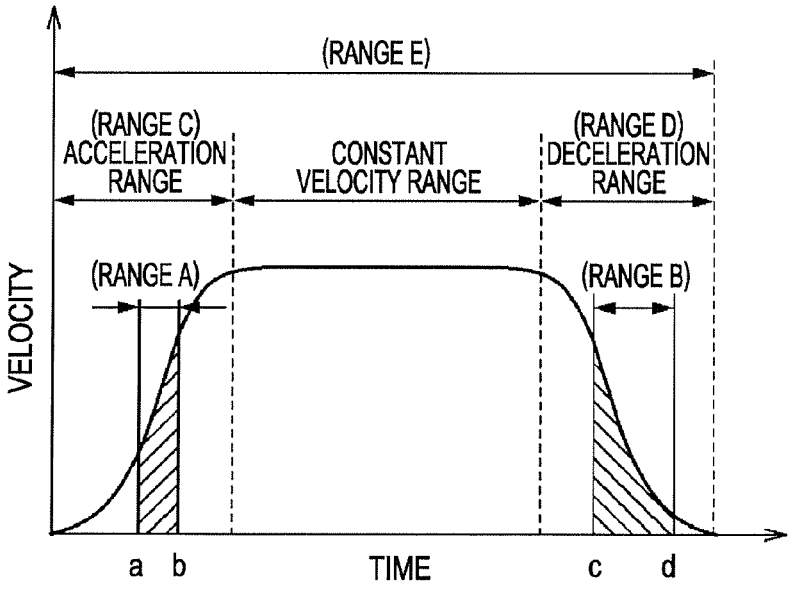
FIG. 10 illustrates ranges in which the velocity of the transport roller varies.

The certain range is a period during which the transport velocity varies while the transport roller 51*a* is operating to transport the medium. FIG. 10 illustrates the certain range. As in FIG. 8, FIG. 10 illustrates the time-varying transport velocity of the medium transported by the transport roller 51*a*.

In this embodiment, the certain range can be set to a particular range (A), which is indicated by hatching, from a point in time "a" to a point in time "b" in the acceleration range in FIG. 10. Alternatively, the certain range can be set to a particular range (B), which is indicated by hatching, from a point in time "c" to a point in time "d" in the deceleration range in FIG. 10. Since the transport velocity caused by the transport roller 51*a* varies with time in these ranges, medium transport is likely to be affected by an inertia as described above. Therefore, the absolute value of a difference between an amount by which the medium is transported by the transport adjusting roller 61*a* and an amount by which the medium is transported by the roll paper body RP is made larger than the absolute value of a difference between an amount by which the medium is transported by the transport roller 51*a* and an amount by which the medium is transported by the transport adjusting roller 61*a*. The medium thereby has a slack between the transport adjusting roller 61*a* and the roll paper body RP in the certain range, in which the transport velocity changes during a transport operation, and the effect of the inertia generated by the roll paper body RP does not extend to the transport roller 51*a*, achieving a stable transport.

The certain range can also be set to the entire acceleration range (range (C) in FIG. 10) or the entire deceleration range (range (D) in FIG. 10). Furthermore, the certain range can be set to a range from when the transport roller 51*a* starts to be rotated and medium starts to be transported until the rotation is stopped and the medium transport is terminated. That is, the certain range can be set to a range E, which is the sum of the acceleration range, constant velocity range, and deceleration range in FIG. 10. In these cases as well, when an amount by which the medium is transported by each roller is adjusted in the relevant range, the medium has a slack between the transport adjusting roller 61*a* and the roll paper body RP. Since the inertia generated by the roll paper body RP is eliminated by the slack of the medium, the effect of the inertia on the rotational operation of the transport roller 51*a* can be suppressed.

Alternatively, the certain range may be set to a range from when printing starts until it is terminated. Since the printing operation of the printer 10 is carried out by repeating the transport process and dot forming process, the transport roller 51*a* repeatedly starts to be rotated and stopped. That is, a transport velocity variation caused in the range (E) in FIG. 10 is repeated several times during the printing operation. When an amount by which the medium is transported by each roller is adjusted during this repetition, the effect of the inertia generated by the roll paper body RP on the rotational operation of the transport roller 51*a* can be suppressed.

Advantages In the First Embodiment

In this embodiment, the absolute value of a difference between an amount by which the medium is transported by the transport adjusting roller 61*a* and an amount by which the medium is transported by the roll paper body RP is made larger than the absolute value of a difference between an amount by which the medium is transported by the transport roller 51*a* and an amount by which the medium is transported by the transport adjusting roller 61*a* in the certain range in which the transport velocity of the medium transported by the transport roller 51*a* varies.

Accordingly, the effect of an inertia, which causes a problem when the rotational speed of the transport roller 51*a* varies during printing, is eliminated by the slack of the medium and the effect of the inertia thereby does not extend to the transport roller 51*a* disposed downstream in the transport direction. Since the transport roller 51*a* is not affected by the inertia, the medium can be accurately transported.

In this embodiment, a certain tension is applied to the medium while it is being transported between the transport roller 51*a* and the transport adjusting roller 61*a*. That is, the medium is neither slackened nor wrinkled downstream of the transport roller 51*a* in the transport direction. Accordingly, the medium is not slackened in an area, on the platen 55, in which printing is actually carried out, so the problem that ink dots expelled from the head adhere to incorrect positions is less likely to occur and printed images with superior quality can be obtained.

Variation of the First Embodiment

In the embodiment described above, the slack sensor 68 has been used to detect the amount of slack of the medium between the roll paper body RP and the transport adjusting roller 61*a*. However, the amount of slack of the medium can also be detected by using another method.

Figure 11:
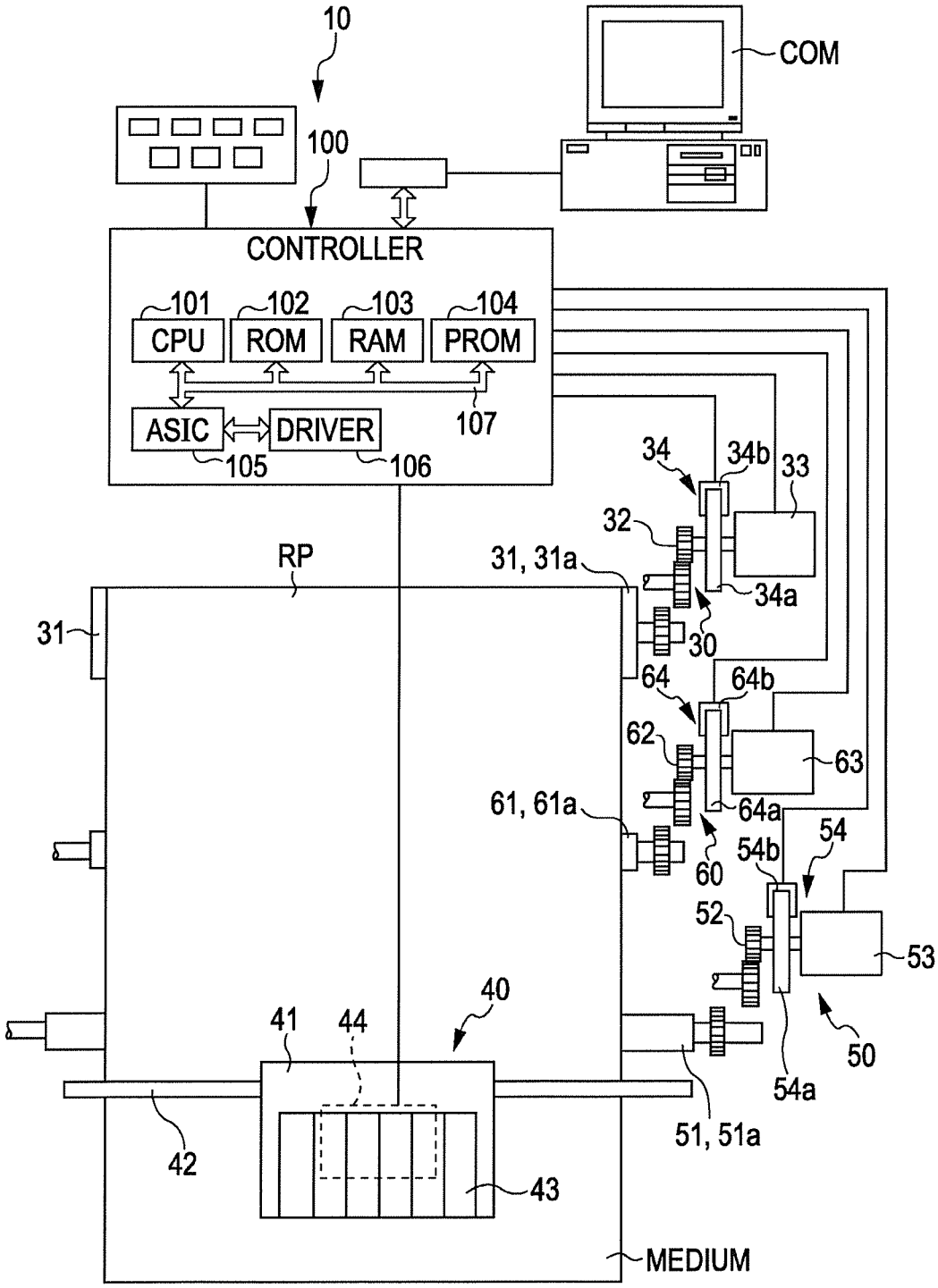
FIG. 11 shows a relation, in a variation of the first embodiment, between a control system and a driving system in which a DC motor is used.
Figure 12:
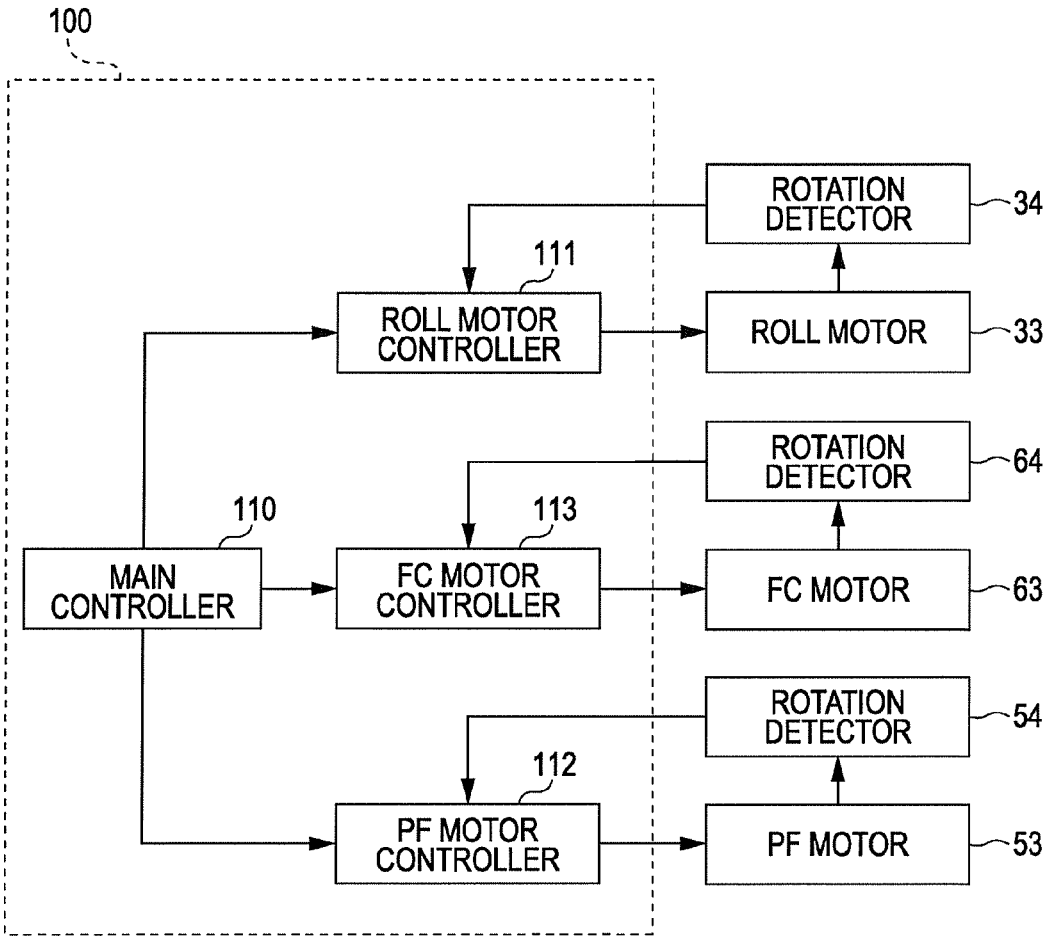
FIG. 12 is a block diagram showing an example of the functional structure of the controller in the variation of the first embodiment.

FIG. 11 shows a relation, in a variation of the first embodiment, between a control system and a driving system in which a DC motor is used. FIG. 12 is a block diagram showing an example of the functional structure of the controller 100 in the variation of the first embodiment.

In this variation, the roll paper body driving mechanism 30 has the rotation detector 34 (see FIG. 11). The slack sensor 68 is not used. The printer structure excluding the slack sensor 68 is the same as in the first embodiment.

The rotation detector 34 uses a rotary encoder similar to the rotary encoder in the rotation detectors 54 and 64; the rotation detector 34 has a discal scale 34*a* and a rotary sensor 34*b*. The discal scale 34*a* has transmitting portions through which light is transmitted and shielding portions that shield light at constant intervals in the circumferential direction. The main components of the rotary sensor 34*b* are a light emitting device, a light receiving device, and a signal processing circuit (none of these components are shown). To calculate the amount of slack, the rotation detector 34 for the roll motor 33 detects the amount of rotation of it and the rotation detector 64 for the FC motor 63 detects the amount of rotation of it (see FIG. 12).

Specifically, it is possible to calculate the amount Feed_roll of medium supplied (fed) from the amount of rotation of the roll motor 33, which is obtained from the rotation detector 34, and the diameters of the gear train 32 and roll paper body RP. Since the medium (roll paper) supplied from the roll paper body RP is gradually consumed during printing, the diameter of the roll paper body RP changes as the printing proceeds. Therefore, the diameter of the roll paper body RP is inferred according to the amount of medium that has been already transported. It is also possible to calculate the amount Feed_fc of medium transported from the amount of rotation of the FC motor 63, which is obtained from the rotation detector 64, and the diameters of the gear train 62 and transport adjusting roller 61*a*. When the amount Feed_fc of transport is subtracted from the amount Feed_roll of supply, the current amount of slack can be inferred.

The method of controlling the rollers, excluding the roller used to detect the amount of slack, is the same as in the first embodiment.

Second Embodiment

Figure 13:
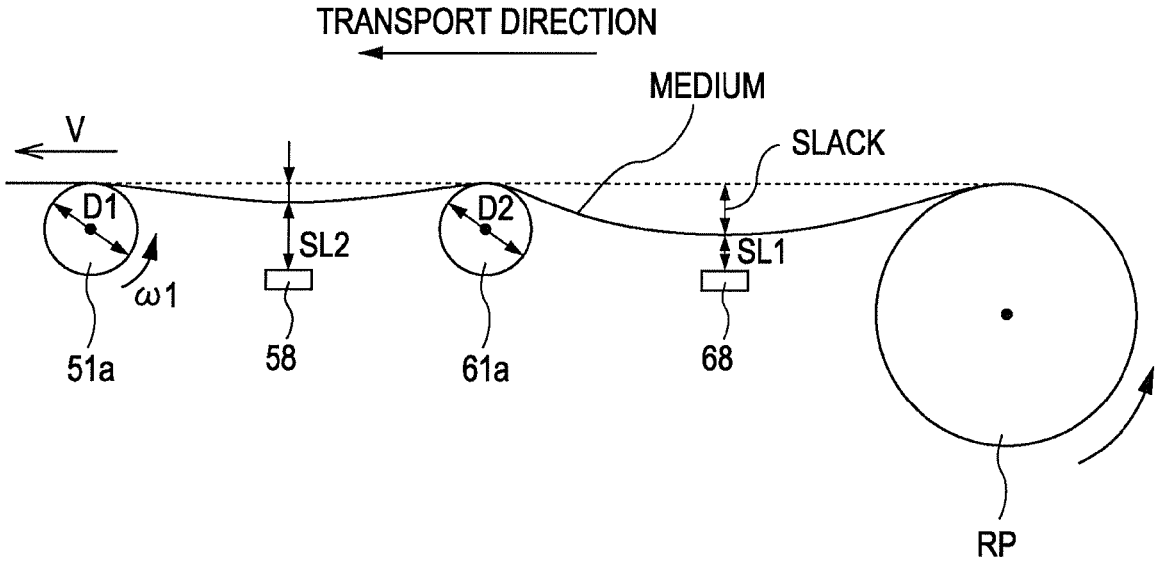
FIG. 13 schematically shows the rotations of rollers and the slacks of the medium when it is transported in a second embodiment.
Figure 14:
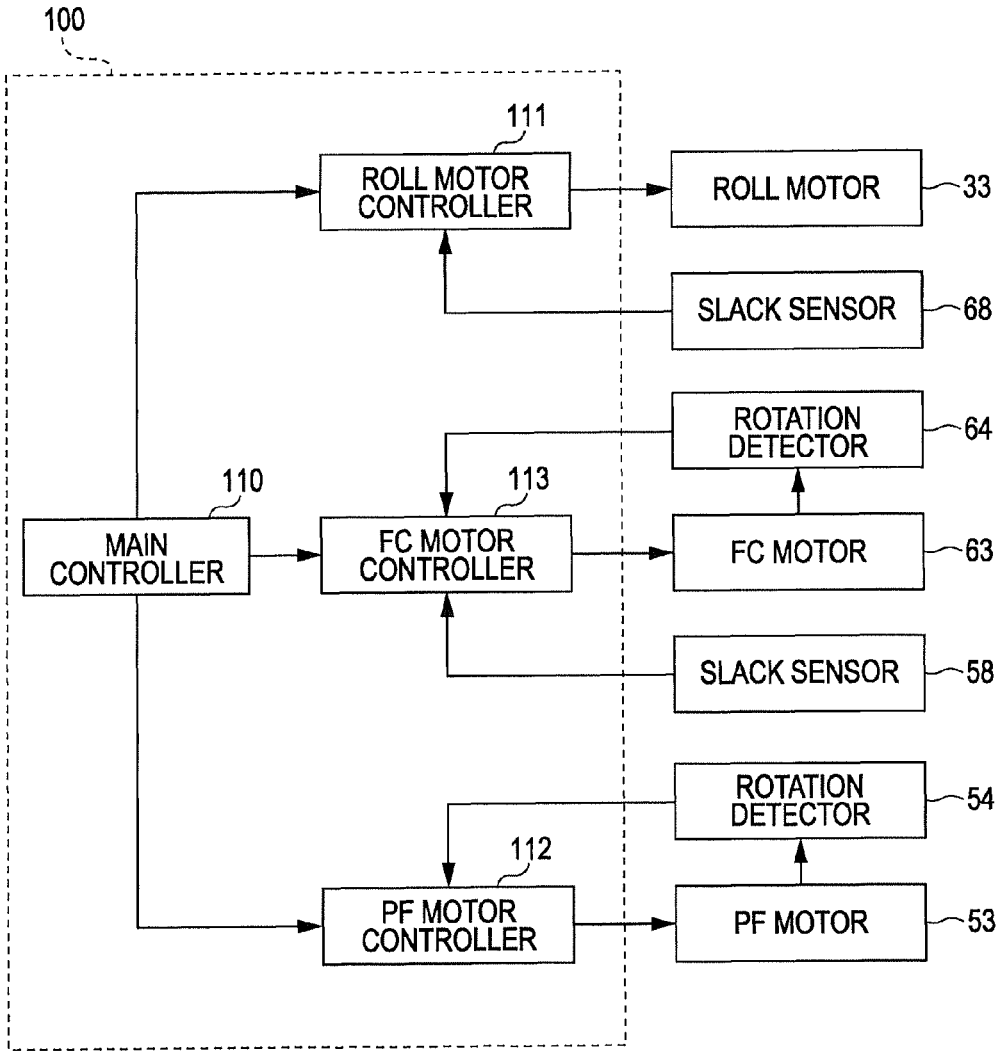
FIG. 14 is a block diagram showing an example of the functional structure of the controller in the second embodiment.

In a second embodiment, the slack of the medium between the transport adjusting roller 61*a* and the transport roller 51*a* is also used in control. FIG. 13 schematically shows the rotations of rollers and the slacks of the medium when it is transported in the second embodiment. FIG. 14 is a block diagram showing an example of the functional structure of the controller 100 in the second embodiment.

In the second embodiment, the slack sensor 58 is provided between the transport adjusting roller 61*a* and the transport roller 51*a* to detect a slack of the medium therebetween (see FIG. 13). As with the slack sensor 68, the slack sensor 58, which is disposed below the medium, can detect the vertical position of the medium (vertical relative position between the medium and the slack sensor 58) between the transport adjusting roller 61*a* and the transport roller 51*a*. When the slack sensor 58 is used, it is possible to obtain the amount of slack of the medium, relative to a vertical transport position with the medium not slackened (with the medium tensioned).

The components other than the slack sensor 58 are the same as in the first embodiment.

Controlling the Rotation of the Transport Roller 51*a*

Control of the transport roller 51*a* is the same as in the first embodiment. That is, to transport the medium at the certain velocity V in the transport direction, the transport roller 51*a* is rotated at the angular velocity $\overline{\omega}1$ that satisfies $V=\overline{\omega}1\times D1/2$.

The PF motor controller 112 produces a PWM output and drives the PF motor 53 to rotate the transport roller 51*a* at the angular velocity $\overline{\omega}1$. The amount of rotation of the PF motor 53 per unit time is monitored by the rotation detector 54. When the amount of rotation of the PF motor 53 is detected, the current angular velocity of the transport roller 51*a* is calculated from the relationship between the detected amount of rotation and the gear ratio of the gear train 52. Then, the PF motor controller 112 appropriately controls the rotational speed of the transport roller 51*a* so that the medium is stably transported.

Controlling the Rotation of the Transport Adjusting Roller 61*a*

The amount of rotation of the transport adjusting roller 61*a* is controlled according to the amount of slack detected by the slack sensor 58. The slack sensor 58, which is disposed below the medium between the transport roller 51*a* and the transport adjusting roller 61*a* as shown in FIG. 13, detects a distance SL2 from the medium to be transported (vertical relative position between the medium and the slack sensor 58).

The FC motor controller 113 controls the FC motor 63 so that the amount of slack of the medium reaches a predetermined target amount of slack. For example, when rotating the FC motor 63, the FC motor controller 113 calculates the current amount of slack from SL2 detected by the slack sensor 58 and controls the duty ratio of the FC motor 63 under proportional-integral-derivative (PID) control so that the difference obtained by subtracting the current calculated amount of slack from the target amount of slack becomes zero. Then, the medium can be transported while an appropriate amount of slack is kept. When the amount of slack is set to 0 mm, the medium is transported without being slackened between the transport adjusting roller 61*a* and the transport roller 51*a*.

Controlling the Rotation of the Roll Paper Body RP

The amount of rotation of the roll paper body RP is controlled as in the first embodiment. That is, the amount of slack between the roll paper body RP and the transport adjusting roller 61*a* is a predetermined amount of slack or more, so the medium is transported while being kept slackened.

Advantages in the Second Embodiment

In this embodiment as well, motor control is carried out so that the medium is adequately slackened between the transport adjusting roller 61*a* and the roll paper body RP in a certain range in which the transport velocity changes, as in the first embodiment. Accordingly, the effect of an inertia, which causes a problem when the rotational speed of the transport roller 51*a* varies, is eliminated by the slack of the medium and the effect of the inertia thereby does not extend to the transport roller 51*a* disposed downstream in the transport direction. Since the transport roller 51*a* is not affected by the inertia, the medium can be accurately transported.

Furthermore, in this embodiment, the amount of slack of the medium is also monitored between the transport roller 51*a* and the transport adjusting roller 61*a* to control the motor, enabling the medium to be slackened therebetween. Since the target amount of slack can be set to a desired value, an optimum transport can be achieved according to the material and type of the medium used for printing. If a thin medium is used, for example, there may be a case in which a relatively strong tension should be applied to suppress wrinkles. In this case, the target amount of slack is set to 0 mm. If the medium is not easily wrinkled, the target amount of slack is set to a slightly large value to prevent an extra load from being applied to the rotational operation of the transport roller 51*a*. Thus, an optimum medium transport can be achieved under various printing conditions.

Variation of the Second Embodiment

To detect the amount of slack of the medium between the transport adjusting roller 61*a* and the transport roller 51*a*, it is also possible to infer the amount of slack from the amounts of rotations of various motors, without using the slack sensor 58. The structure of the printer in a variation of the second embodiment is the same as in the second embodiment, except that the slack sensor 58 is not used.

Figure 15:
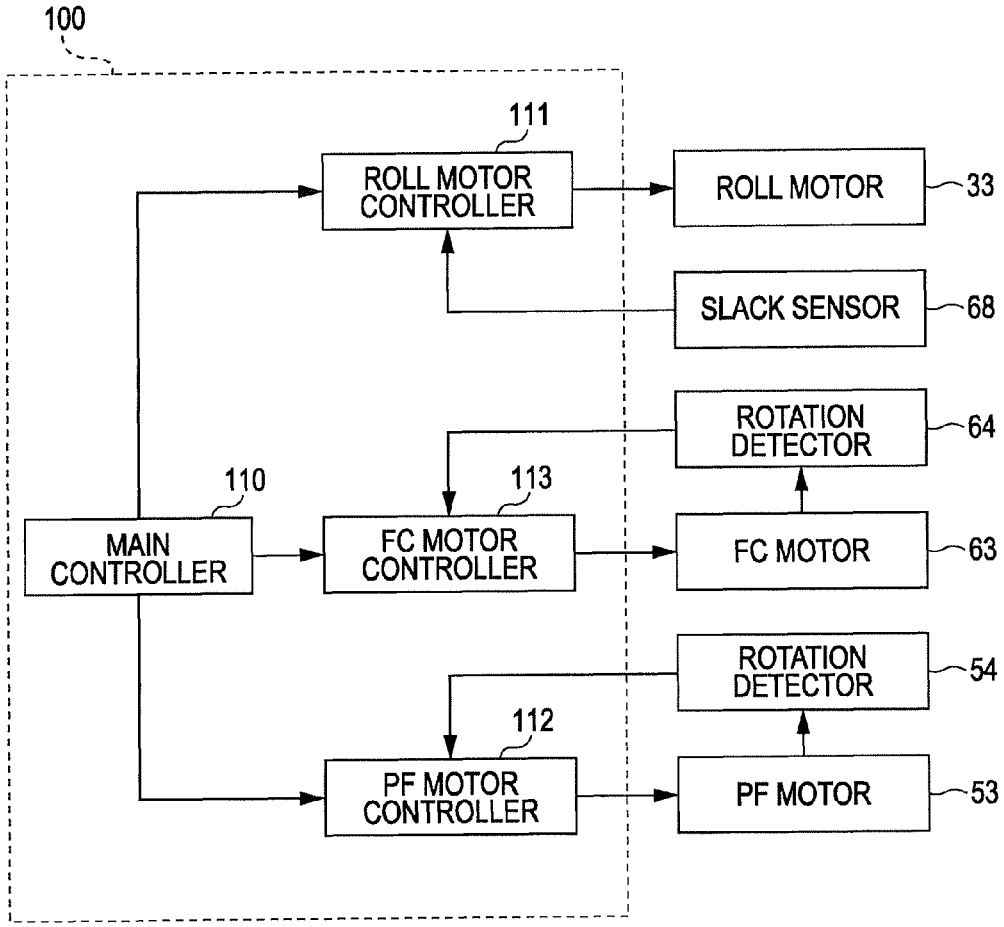
FIG. 15 is a block diagram showing an example of the functional structure of the controller in a variation of the second embodiment.

FIG. 15 is a block diagram showing an example of the functional structure of the controller 100 in the variation of the second embodiment. In this variation, it is possible to calculate the amount Feed_pf of medium supplied (fed) from the amount of rotation of the PF motor 53, which is obtained from the rotation detector 54, and the diameters of the gear train 52 and transport roller 51*a*, in the same way as described in the variation of the first embodiment. It is also possible to calculate the amount Feed_fc of medium transported from the amount of rotation of the FC motor 63, which is obtained from the rotation detector 64, and the diameters of the gear train 62 and transport adjusting roller 61*a*. When the amount Feed_fc of transport is subtracted from the amount Feed_pf of supply, the current amount of slack can be inferred.

Other Embodiments

Although a printer in an embodiment has been described, the above embodiments should not be construed as restricting the invention; they are described to facilitate the understanding of the invention. It will be appreciated that modifications and variations may be made in the invention and that the invention includes its equivalents. In particular, even the embodiment described below is included in the invention.

The above embodiments have been described for a case in which a motor control apparatus is provided in the printer 10. However, the location of the motor control apparatus is not limited to the interior of the printer 10; the motor control apparatus may be applied to, for example, a facsimile machine that uses a roll paper body (roll paper).

About the Printer

In the above embodiments, a serial scanning type of printer, in which the head moves together with the carriage, has been described as an example. However, the printer 10 may be a so-called line printer, in which the head is secured.

The printer 10 may be part of a composite apparatus such as a scanner or copy machine. Furthermore, although the above embodiments have been described for the printer 10 that uses the ink jet method, the printer 10 is not limited to an ink jet printer; any printer that can expel a jet of fluid can be used. For example, the embodiments can be applied to gel jet printers, printers using toner, dot-impact printers, and other various types of printers.

Plotters are also included as types of printers.

About Inks Used

In the above embodiments, four colored inks, which are cyan (C), magenta (M), yellow (Y), and black (K), can be used for printing. Dye inks, pigment inks, and other types inks can be used. Light cyan inks, light magenta inks, white inks, clear inks, and inks of other colors other than CMYK can also be used.

About the Medium

In the above embodiments, the medium has been roll paper. However, film members, resin sheets, aluminum foils, and other types of materials other than paper can be used.

About the Controller

The controller 100 is not limited to the one in the above embodiments. For example, the controller 100 may be structured so that the ASIC 105 alone controls the roll motor 33, PF motor 53, and FC motor 63. Alternatively, the controller 100 may be structured by combining a single-chip microcomputer in which various peripheral units are incorporated.

What is claimed is:

1. A printer, comprising:

a roll paper body driving mechanism configured to transport a medium in a transport direction by rotating a roll paper body on which the medium is wound in a roll shape, the roll paper body driving mechanism including a rotational holder that is configured to support the roll paper body;

a roll paper body driver that drives the roll paper body driving mechanism;

a first transport mechanism provided downstream of the rotational holder in the transport direction to transport the medium;

a first driver that drives the first transport mechanism;

a print head provided downstream of the first transport mechanism in the transport direction to carry out printing on the medium;

a second transport mechanism provided between the rotational holder and the first transport mechanism to transport the medium;

a second driver that drives the second transport mechanism; and a controller configured to control operations of the roll paper body driver, the first driver, and the second driver based on an amount of slack between the roll paper body driving mechanism and the second transport mechanism such that, in a timing at which a velocity at which the first transport mechanism transports the media changes, an absolute value of a difference between an amount by which the medium is transported by the roll paper body driving mechanism and an amount by which the medium is transported by the second transport mechanism being larger than an absolute value of a difference between an amount by which the medium is transported by the second transport mechanism and an amount by which the medium is transported by the first transport mechanism, the amount of slack indicating a slack amount of the medium slacking in a slacking direction relative to a hypothetical line that indicates a transport route where the medium is transported without slacking in the slacking direction between the roll paper body driving mechanism and the second transport mechanism, the slacking direction intersecting the transport direction.

2. The printer according to claim 1, wherein the controller controls the operations of the roll paper body driver, the first driver, and the second driver so that, in a range from when the first transport mechanism starts transport of the medium until the first transport mechanism terminates the transport of the medium, the absolute value of a difference between an amount by which the medium is transported by the roll paper body driving mechanism and an amount by which the medium is transported by the second transport mechanism is larger than the absolute value of a difference between an amount by which the medium is transported by the second transport mechanism and an amount by which the medium is transported by the first transport mechanism.

3. The printer according to claim 1, wherein the controller controls the operations of the roll paper body driver, the first driver, and the second driver so that, in a range from when the print head starts printing on the medium until the print head terminates the printing, the absolute value of a difference between an amount by which the medium is transported by the roll paper body driving mechanism and an amount by which the medium is transported by the second transport mechanism is larger than the absolute value of a difference between an amount by which the medium is transported by the second transport mechanism and an amount by which the medium is transported by the first transport mechanism.

4. The printer according to claim 1, further comprising a slack detector that detects the amount of slack of the medium, wherein:

the controller drives the roll paper body driving mechanism if the amount of slack detected by the slack detector is less than or equal to a predetermined amount of slack; and the controller stops the roll paper body driving mechanism if the amount of slack detected by the slack detector is larger than the predetermined amount of slack.

5. The printer according to claim 1, wherein:

the controller detects the amount of slack of the medium according to an amount by which the medium is transported by the roll paper body driving mechanism and an amount by which the medium is transported by the second transport mechanism;

the controller drives the roll paper body driving mechanism if the amount of detected slack is less than or equal to a predetermined amount of slack; and the controller stop the roll paper body driving mechanism if the amount of detected slack is larger than the predetermined amount of slack.

6. A printing method, comprising:

transporting a medium in a transport direction by driving a roll paper body driving mechanism that drives a roll paper body on which the medium is wound in a roll shape, the roll paper body driving mechanism including a rotational holder that is configured to support the roll paper body;

transporting the medium by driving a first transport mechanism provided downstream of the rotational holder in the transport direction;

carrying out printing on the medium by using a print head provided downstream of the first transport mechanism in the transport direction;

transporting the medium by driving a second transport mechanism provided between the rotational holder and the first transport mechanism; and controlling the driving of the roll paper body driving mechanism, the driving of the first transport mechanism, and the driving of the second transport mechanism based on an amount of slack between the roll paper body driving mechanism and the second transport mechanism to make, in a timing in which a velocity at which the first transport mechanism transports the media changes, an absolute value of a difference between an amount by which the medium is transported by the roll paper body driving mechanism and an amount by which the medium is transported by the second transport mechanism being larger than an absolute value of a difference between an amount by which the medium is transported by the second transport mechanism and an amount by which the medium is transported by the first transport mechanism, the amount of slack indicating a slack amount of the medium slacking in a slacking direction relative to a hypothetical line that indicates a transport route where the medium is transported without slacking in the slacking direction between the roll paper body driving mechanism and the second transport mechanism, the slacking direction intersecting the transport direction.

7. A printer, comprising:

a roll paper body driving mechanism configured to transport a medium in a transport direction by rotating a roll paper body on which the medium is wound in a roll shape and a roll paper body driver that drives the roll paper body driving mechanism, the roll paper body driving mechanism including a rotational holder that is configured to support the roll paper body;

a first transport mechanism provided downstream of the rotational holder in the transport direction to transport the medium and a first driver that drives the first transport mechanism;

a print head provided downstream of the first transport mechanism in the transport direction to carry out printing on the medium;

a second transport mechanism provided between the rotational holder and the first transport mechanism to transport the medium and a second driver that drives the second transport mechanism; and a controller configured to control operations of the roll paper body driver, the first driver, and the second driver based on an amount of slack between the roll paper body driving mechanism and the second transport mechanism such that the medium is more slackened, in a timing at which a velocity at which the first transport mechanism transports the media changes, between the roll paper body and the second transport mechanism than between the first transport mechanism and the second transport mechanism, the amount of slack indicating a slack amount of the medium slacking in a slacking direction relative to a hypothetical line that indicates a transport route where the medium is transported without slacking in the slacking direction between the roll paper body driving mechanism and the second transport mechanism, the slacking direction intersecting the transport direction.

8. A printing method, comprising:

transporting a medium in a transport direction by driving a roll paper body driving mechanism that drives a roll paper body on which the medium is wound in a roll shape, the roll paper body driving mechanism including a rotational holder that is configured to support the roll paper body;

transporting the medium by driving a first transport mechanism provided downstream of the roll paper body in the transport direction;

carrying out printing on the medium by using a print head provided downstream of the rotational holder in the transport direction;

transporting the medium by driving a second transport mechanism provided between the rotational holder body and the first transport mechanism; and controlling the driving of the roll paper body driving mechanism, the driving of the first transport mechanism, and the driving of the second transport mechanism based on an amount of slack between the roll paper body driving mechanism and the second transport mechanism to transport the medium so that the medium is more slackened, in a timing at which a velocity at which the first transport mechanism transports the media changes, between the roll paper body and the second transport mechanism than between the first transport mechanism and the second transport mechanism, the amount of slack indicating a slack amount of the medium slacking in a slacking direction relative to a hypothetical line that indicates a transport route where the medium is transported without slacking in the slacking direction between the roll paper body driving mechanism and the second transport mechanism, the slacking direction intersecting the transport direction.

9. The printer according to claim 4, wherein the slack detector is arranged between the roll paper body driving mechanism and the second transport mechanism in the transport direction and configured to detect a distance between the medium and the slack detector in the slacking direction.

10. The printer according to claim 5, further comprising a first rotation detector configured to detect a first amount of rotation of the roll paper body driver, and a second rotation detector configured to detect a second amount of rotation of the second driver, wherein the controller detects the amount of slack by calculating the amount of slack, using the first amount of rotation and the second amount of rotation.

* * * * *